US005108309A

United States Patent [19]

Oda et al.

[11] Patent Number: 5,108,309

[45] Date of Patent: Apr. 28, 1992

[54] ELECTRICAL CONNECTOR HAVING A RESILIENT CONTACT LATCH

[75] Inventors: Kenzo Oda, Hadano; Seiji Hirano, Hiroshima, both of Japan

[73] Assignee: AMP Incorporated, Harrisburg, Pa.

[21] Appl. No.: 680,633

[22] Filed: Apr. 1, 1991

Related U.S. Application Data

[63] Continuation of Ser. No. 416,898, Oct. 4, 1989, abandoned.

[30] Foreign Application Priority Data

Oct. 26, 1988 [JP] Japan ..... 63-139460[U]

[51] Int. Cl.[5] ..... H01R 13/422

[52] U.S. Cl. ..... 439/595; 439/910

[58] Field of Search ..... 439/595, 596, 744, 871, 439/910, 752

[56] References Cited

U.S. PATENT DOCUMENTS

| | | | |
|---|---|---|---|
| 4,343,523 | 8/1982 | Cairns et al. | 439/595 |
| 4,565,416 | 1/1986 | Rudy et al. | 439/595 |
| 4,776,813 | 10/1988 | Wilson et al. | 439/595 |
| 4,820,198 | 4/1989 | Lulko et al. | 439/595 |

*Primary Examiner*—Neil Abrams

*Attorney, Agent, or Firm*—Adrian J. LaRue; Allan B. Osborne

[57] ABSTRACT

A dielectric housing (11) of an electrical connector (10) comprises a contact-receiving passageway (13) in which an electrical contact (25') is secured by a resilient housing lance (14). A locking member (20, 25) is movable along the passageway (13) and has a projection (21) that is positioned in a space (15) between the passageway wall (**13*a*) and the housing lance (14) to prevent the housing lance from moving outwardly. A window (30, 31, 32, 33) is in the housing (11) and exposes a part (20*b*, 25*b*) of the locking member (20, 25) when the projection (21) is positioned in the space (15**) thereby indicating the securing of the contact in the contact-receiving passageway.

3 Claims, 7 Drawing Sheets

ELECTRICAL CONNECTOR HAVING A RESILIENT CONTACT LATCH

This application is a continuation of application Ser. No. 07/416,898 filed Oct. 4, 1989, now abandoned.

FIELD OF THE INVENTION

The present invention relates to an electrical connector capable of easily confirming installation of contacts.

BACKGROUND OF THE INVENTION

Electrical connectors have been widely applied as a means to easily connect and disconnect electrical circuits. Among various types of such connectors, there are so-called double-lock connectors having double locks to insure that contacts remain in a predetermined proper position in a connector housing.

Illustrated in FIG. 6 is a cross-sectional view of one example of such a double-lock connector, more specifically an electrical connector for an air bag to be connected to an automobile air bag control circuit.

An electrical contact 25' is inserted from the left hand side into a contact-receiving passageway 13' in a dielectric housing 11' of an electrical connector 10'. As the contact is being inserted, an engaging plate 28' of the contact 25' first lifts a resilient housing lance 14' as shown by the phantom lines before returning it to a normal position as shown by the solid lines, thereby engaging the contact 25' as a first lock to secure the contact 25' in the housing. However, the contact 25' may be removed if it is pulled strongly to the left. In order to prevent the contact from being removed, a locking member 20' having a projection 21' is inserted into the housing with projection 21' being positioned in space 15', thereby preventing the resilient housing lance 14' from lifting up and thus further securing the contact as a second lock in passageway 13'.

It is to be noted here that the engaging plate 28' holds the resilient housing lance at an elevated condition as shown by the phantom lines in FIG. 6 if the contact 25' is improperly inserted. Under such a condition, the gap of the space 15' is too narrow to insert the projection 21' into the space 15'. The tip **21*a*' of the projection 21' engages the tip 14*a*' of the resilient housing lance, thereby preventing the complete insertion of the locking member 20' into housing 11. This condition of the contact 25'** may not be detected by the operator.

This construction permits the confirmation of the complete insertion of the locking member 20' in the housing only from the right hand side in the drawing. However, in a certain circumstance, it is difficult to confirm from the right hand side, thereby providing the need for a mechanism to easily confirm whether the locking member 20' is completely inserted or not in the housing.

SUMMARY OF THE INVENTION

In view of the above, it is an object of the present invention to provide an electrical connector of a construction easily confirming that the connector is properly assembled.

The electrical connector according to the present invention comprises a housing having a contact-receiving passageway, an electrical contact secured in the passageway, a resilient housing lance extending into the contact-receiving passageway and forming a space, the resilient housing lance being resiliently displaced outwardly as the contact is being inserted in the contact-receiving passageway but returning to a normal position after insertion of the contact to prevent the contact from being removed, and a locking member positioned in the housing and having a projection to prevent the resilient housing lance from being displaced by being inserted in the space after returning to the normal position, and a window in the sidewall of the housing to expose a part of the locking member when the projection thereof is positioned in the space.

When the projection is positioned in the space, that is, when the contact is secured in the proper position within the housing, the electrical connector of the present invention has a window in the side wall of the housing to expose a part of the locking member. Thus, an operator can visually confirm through the window if the locking member is visible in the window, thereby allowing the operator to verify that the electrical contact is properly positioned in the housing.

BRIEF DESCRIPTION OF THE DRAWINGS

The invention, together with objects and advantages thereof, is best understood by way of example with reference to the following detailed description in conjunction with the accompanying drawings.

DETAILED DESCRIPTION OF THE INVENTION

The present invention will be described hereunder by reference to the accompanying drawings.

As shown in the front view (FIG. 2B) and the rear view (FIG. 2D), the housing 11 has five contact-receiving passageways 13, one in a left section **11*a* and four in a right section 11*b*** in parallel relationship.

Figure 2A:
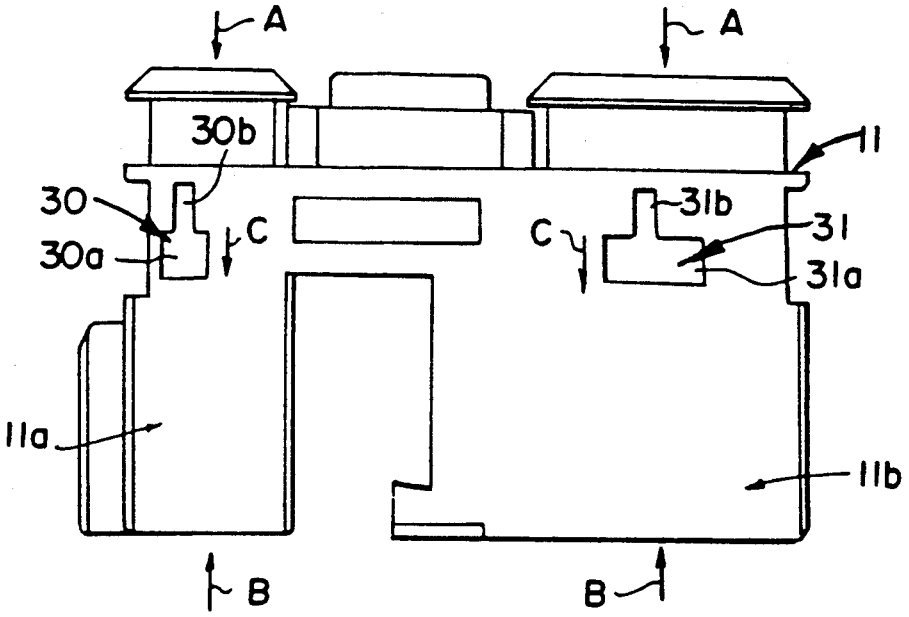
FIGS. 2A through 2D are top plan, front, bottom plan and rear views of the housing of the electrical connector according to the present invention.
Figure 6:
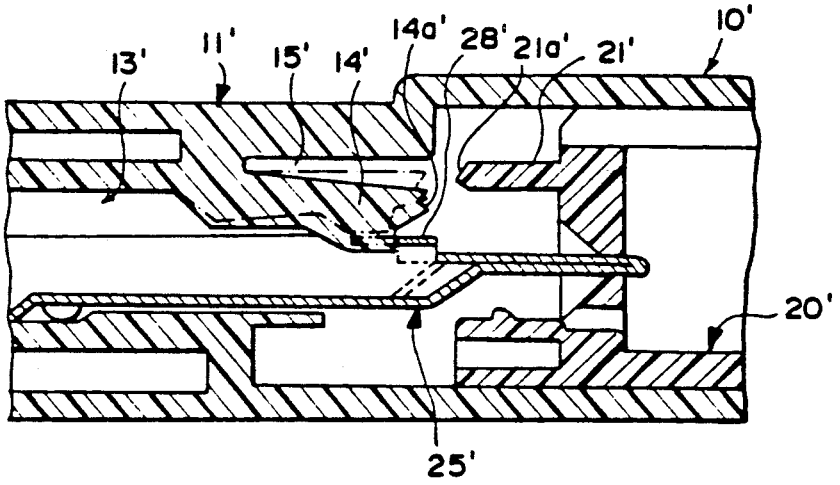
Figure 6 PRIOR ART
FIG. 6 is a cross-sectional view of one example of a conventional double-lock connector.

Electrical contacts (not shown but of the type shown in FIG. 6) are inserted in the housing 11 in the direction as shown by an arrow A in FIG. 2A. Then, the locking members are inserted in the direction as shown by an arrow B. Two T-shaped windows 30, 31 are formed in the housing 11 as shown in FIG. 2A to visualize the locking members through wider rectangular sections **30*a*, 31*a* of the windows 30, 31 if the locking members are properly inserted in the housing 11. Narrower rectangular sections 30*b*, 31*b* of windows 30, 31 are provided to insert any tool such as a screw driver, if necessary, to push the tips of the locking members secured in the housing 11 in the direction as shown by an arrow C in FIG. 2A**, thereby moving the locking members.

Shown in FIGS. 3A through 3E is one example of the locking member 20 to be inserted in the left hand portion 11*a* (see FIGS. 2A and 2B) of the housing 11 as shown in FIGS. 2A through 2D.

Figure 2B:
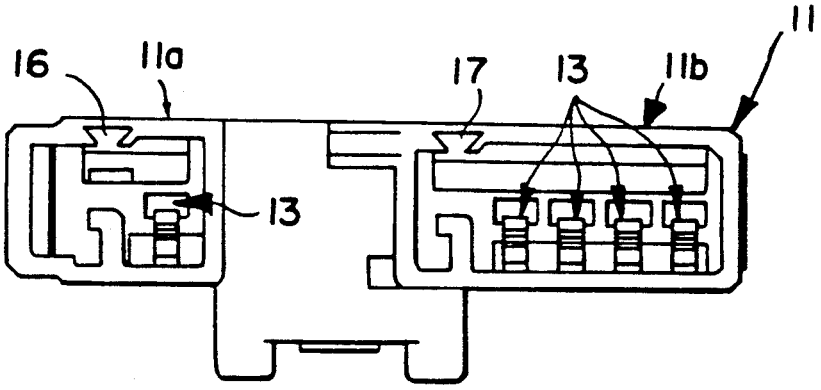
Figure 2C:
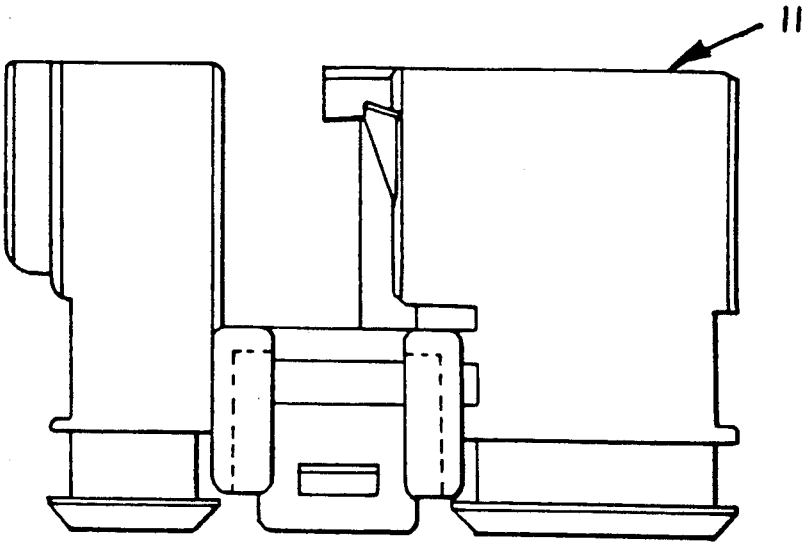
Figure 3A:
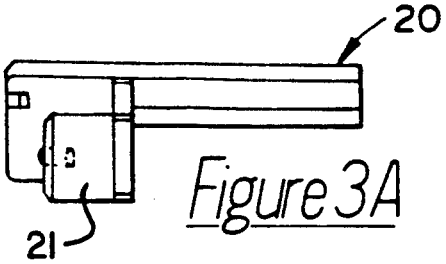
FIGS. 3A through 3E are top plan, left side, front, right side and bottom plan views of one embodiment of the locking member to be inserted in the left side section shown in FIGS. 2A and 2B of the housing shown in FIGS. 2A through 2D, FIGS. 4A through 4E are top plan, left side, front, right side and bottom plan views of another embodiment of the locking member to be inserted in the right side section shown in FIGS. 2A and 2B of the housing shown in FIGS. 2A through 2D.
Figure 3B:
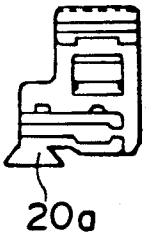
Figure 3C:
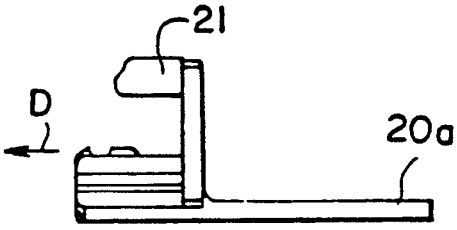

The locking member 20 is inserted in the housing 11 in such a manner that a guide section 20*a* is inserted in an elongated groove 16 as shown in FIG. 2B in the direction of an arrow D in FIG. 3C. If the locking member 20 is inserted in the housing 11 at a proper position, a bottom tip portion 20*b* of the guide section 20*a* as shown in FIG. 3E becomes visible over the entire area of the wide section 30*a* of the window 30 as shown in FIG. 2A.

FIGS. 4A through 4E is another example of the locking member 25 to be inserted in the right hand portion 11*b* (see FIGS. 2A and 2B) of the housing 11 as shown in FIGS. 2A through 2D.

Figure 3D:
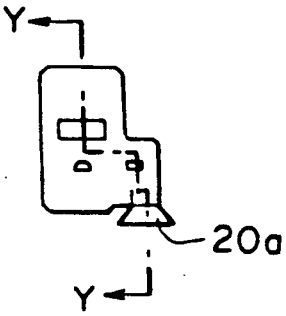
Figure 3E:
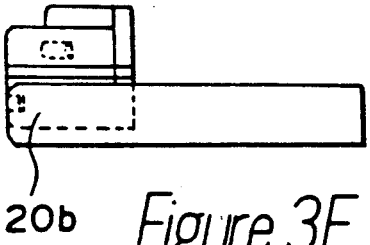
Figure 4A:
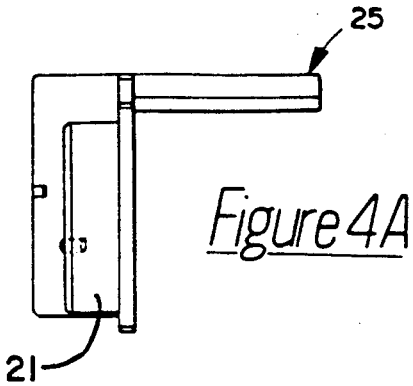
Figure 4B:
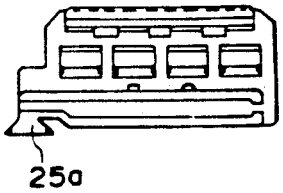
Figure 4C:
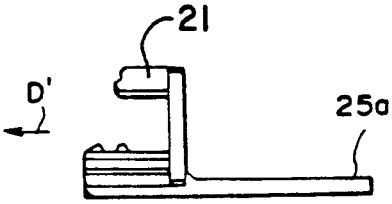
Figure 4D:
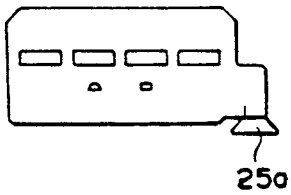
Figure 4E:
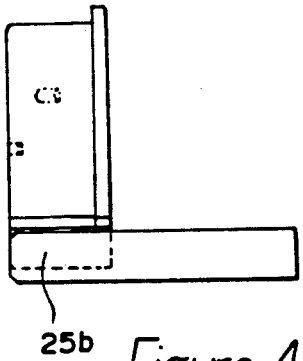

The locking member 25 is inserted in the housing 11 in the direction of an arrow D' in FIG. 4C in the same manner as the locking member 20 in FIGS. 3A through 3E, that is, in such a manner that a guide section 25*a* is inserted in an elongated groove 17 of FIG. 2B. If the locking member 25 is inserted in the housing 11 at a proper position, a bottom tip portion 25*b* of the guide 25*a* as shown in FIG. 4E becomes entirely visible through the wider section 31*a* of the window 31 in FIG. 2A.

Figure 1:
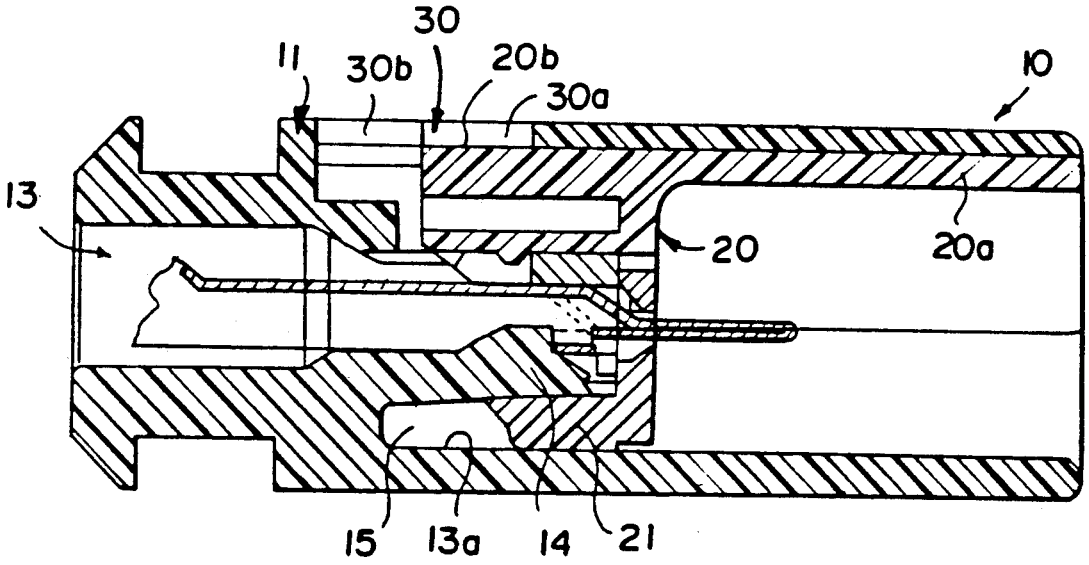
FIG. 1 is a cross-sectional view of the connector housing showing the locking member properly inserted in the housing.
Figure 2D:
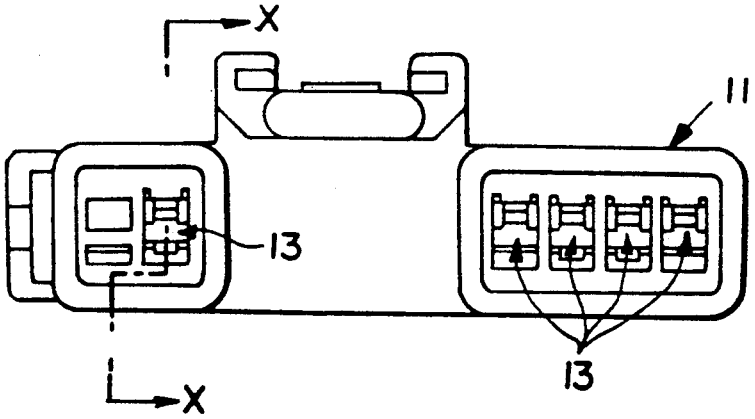

Illustrated in FIG. 1 is a cross-sectional view of the housing of FIG. 2D along the line X—X and the locking member 20 of FIG. 3D along the line Y—Y properly mated with the housing 11, but excluding the contacts. The same reference numerals are used to refer to corresponding elements in FIGS. 2A through FIG. 4E.

A space 15 is formed between the inner wall 13*a* of the contact-receiving passageway 13 in the housing 11 of the connector 10 and the resilient housing lance 14. The projection 21 of the locking member 20 is inserted in the space 15 to prevent the resilient housing lance 14 from moving outwardly. If the locking member 20 is inserted at the proper position as shown in FIG. 1, the tip portion 20*b* of the guide 20*a* of the locking member 20 will be visible through the entire area of the wider section 30*a* of the window 30. This allows the operator to verify that the contacts and the locking members are properly inserted in the housing, i.e., the electrical connector is properly assembled by simply visualizing the portion 20*b* of the locking member 20 through the wider section 30*a* of the window 30.

Figure 5:
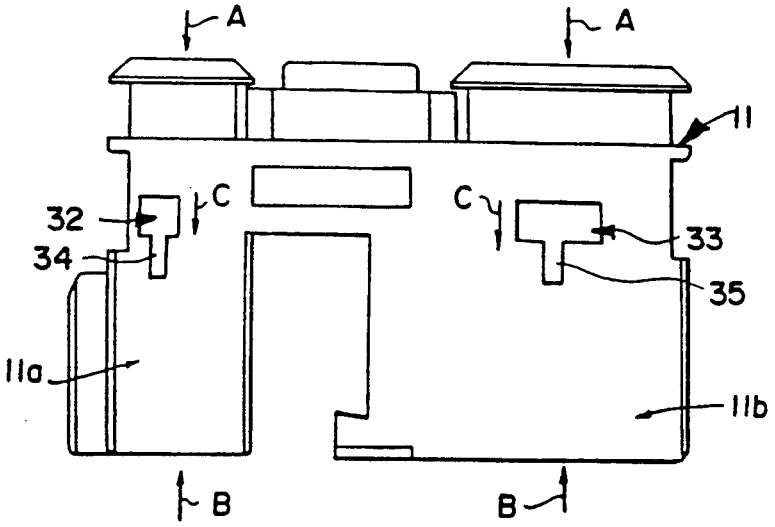
FIG. 5 is a top plan view of the housing according to another embodiment of the present invention.

Shown in FIG. 5 is another embodiment of the electrical connector according to the present invention in which the same reference numerals are used to refer to the same elements as those in the first embodiment in FIG. 2A and their detailed descriptions are omitted herein.

In FIG. 5, windows 32, 33 are rectangular to expose parts of the locking members 20, 25 (see FIG. 1, FIGS. 3A through 3E and FIGS. 4A through 4E) when they are positoned within the spaces 15 (see FIG. 1). In the alternative embodiment, however, there are also provided windows 34, 35 as continuations of the windows 32, 33 to expose parts of the locking members 20, 25 in case of incomplete insertion of the locking members 20, 25. Consequently, the windows in FIG. 5 are essentially reversed in direction as compared with the windows of first embodiment in FIG. 2A.

In this manner to partly expose the locking members if they are improperly inserted, this alternative embodiment allows the operator to distinguish three conditions, i.e., no insertion of the locking members, imcomplete insertion of the locking members and proper insertion of the locking members. It may be possible to provide grooves in the locking members to be exposed through the windows 32, 33 so that a tool such as a screw driver may be inserted in such grooves to push the locking members 20, 25 in the direction of the arrow C of FIGS. 2A, 5. It is, of course, possible to provide narrower rectangular sections at upper portions of the windows 32, 33 similar to FIG. 2A.

It is to be noted, however, that the windows exposing parts of the locking members 20, 25 in case of improper insertion are not limited to the shown embodiments and may be any desired shape.

Although only one of the mating electrical connectors is disclosed in the above embodiments, the present invention may be applied to the other connector. Also, the present invention is not limited to the above-mentioned electrical connector but applicable to any other types of electrical connectors.

The present invention has windows in the wall of the housing through which parts of the locking members are visible if they are inserted properly, thereby providing a simple means to verify through the windows whether or not the electrical connector is properly assembled.

We claim:

1. A dielectric housing of an electrial connector for securing an electrical contact in a contact-receiving passageway and for indicating the securing of the contact therein, comprising:

a resilient housing lance extending along the contact-receiving passageway with a space between a wall of the housing and the housing lance permitting the housing lance to move outwardly from a normal position when the contact is inserted into the passageway and to return to the normal position to secure the contact in the passageway;

a locking member movable along the contact-receiving passageway and having a projection for insertion in said space to prevent the housing lance from moving outwardly; and said housing being provided with a window in a side wall of said housing and opposite to the longitudinal extend of said housing lance along said passageway, said housing lance being located between said window and said space with said window exposing a part of said locking member when said projection is positioned in said space thereby indicating the securing of the contact in the contact-receiving passageway.

2. A dielectric housing as claimed in claim 1, wherein said window has a T-shape.

3. A dielectric housing as claimed in claim 1, wherein said passageway has an elongated groove and said locking member has a guide section disposed in said elongated groove.

* * * * *